US006454661B1

(12) United States Patent
Peters

(10) Patent No.: US 6,454,661 B1
(45) Date of Patent: Sep. 24, 2002

(54) GOLF CLUB WITH SMOKING PIPE ATTACHMENT

(76) Inventor: Frank W. Peters, R.D. #1, Box 891, New Alexandria, PA (US) 15670

( * ) Notice: Subject to any disclaimer, the term of this patent is extended or adjusted under 35 U.S.C. 154(b) by 0 days.

(21) Appl. No.: 09/863,505

(22) Filed: May 23, 2001

(51) Int. Cl.[7] ..... A63B 57/00; A24F 13/12
(52) U.S. Cl. ..... 473/282; 131/178
(58) Field of Search ..... 131/176, 177, 131/216, 226, 260, 329, 330, 222, 225, 227, 228, 229, 178, 200; 473/282

(56) References Cited

U.S. PATENT DOCUMENTS

D61,660 S * 11/1922 Kahookano
D146,866 S * 6/1947 Mellor
4,204,551 A * 5/1980 Robinson
5,884,632 A * 3/1999 Brauer
D442,329 S * 5/2001 Najar
D447,276 S * 8/2001 Gustafson

FOREIGN PATENT DOCUMENTS

DE 296 09 240 U1 * 10/1996

* cited by examiner

*Primary Examiner*—Stephen Blau
(74) *Attorney, Agent, or Firm*—David G. Oberdick

(57) ABSTRACT

A novelty golf club with a smoking pipe attachment adaptable for smoking. A pipe bowl assembly is inserted into the hollow shaft of a golf club, and a mouthpiece assembly is inserted at the top of the shaft. The hollow shaft carries pipe smoke from the bowl assembly to the pipe assembly.

6 Claims, 3 Drawing Sheets

GOLF CLUB WITH SMOKING PIPE ATTACHMENT

FIELD OF THE INVENTION

This invention relates to a novelty golf club with a smoking pipe attachment.

BACKGROUND AND SUMMARY OF THE INVENTION

The present invention relates to a novelty golf club with a smoking pipe attachment.

It is growing more common for those engaged in the game of golf to combine this sporting activity with another leisure enjoyment, namely, smoking. It has been observed that the game of golf may be one of the few activities where smoking is not discouraged. Indeed, the combination of smoking and golf appears to be mutually complementary in respect to providing enjoyment to a golfer on a golf course.

Separate and apart from this coextensive interest in smoking, golfers typically use a variety of tools and accessories in connection with their golfing game. Such tools and accessories including, ball washers, cleat cleaners, turf repair tools, ball retrievers and ball markers.

With the growing and increased interest in smoking on the golf course, additional tools and accessories have been developed to accommodate both of these leisure activities on a simultaneous basis. For example, U.S. Pat. No. 5,759,120 discloses a multi-function golfer's cart cigar tool including a body with a cigar cutter, an arrangement for repairing a ball mark on the golf course, a cigar support stand and a golf club support stand.

U.S. Pat. No. 5,788,197 discloses a golf assembly with cigar holding features. In particular, this invention provides an assembly which will support a cigar off of the playing surface of a golf course while a golfer is otherwise occupied with his turn at golf.

U.S. Pat. No. 5,819,751 describes a golfer's tool which includes a body, a pair of prongs, a cutter and a clip. The pair of prongs extend from one end of the body and are used for repairing ball marks. The cutter includes a slide blade within the body and a central passage extending through the body transversely of the path of the blade. The blade is used to cut the tip off of a cigar inserted in the central passage. The clip is mounted on the portion of the tool away from the pair of prongs and includes a spring located between two sets of arms. The spring biases one of the sets of arms toward the other for holding a cigar or a cigarette.

U.S. Pat. No. 5,868,143 describes a cigar and cigarette holder that attaches to a golf bag.

Finally, U.S. Pat. No. 5,909,735 describes a smoking article holder that is lightweight, inexpensive and can be used to retain a player's smoking article during a round of golf.

The present invention incorporates a functional smoking device, namely, a pipe, into a golf club. More specifically, the present invention preferably incorporates a smoking pipe into a putter.

SUMMARY OF THE INVENTION

It is accordingly an object of the present invention to provide a golf club which incorporates a smoking means and, in particular, a smoking pipe.

To that end, a standard golf club includes a hollow shaft with a golf club at one end and a rubber grip at the other. In a preferred embodiment of the present invention, a hole is drilled into the center of the cap of the rubber grip at the upper end of the golf club shaft. A mouthpiece assembly is inserted into this center hole within the cap of the rubber grip. This mouthpiece assembly, in a preferred embodiment of the present invention, includes a pipe mouthpiece, a standard pipe filter, a filter holder and a stem filter seal. The filter holder is inserted into the stem filter seal. In a preferred embodiment, the bottom parts of the stem filter seal and the filter holder are flush with each other and the top part of the filter holder extends above the top of the stem filter seal. This subassembly of the stem filter seal and filter holder are inserted into the top of the hollow golf club shaft so that the top of the stem filter seal is flush with the top of the golf club shaft. In a preferred embodiment, the rubber grip, after insertion of the subassembly, is placed over the golf club shaft. The standard pipe filter is inserted through the hole in the cap of the rubber grip and into the subassembly including the stem filter seal and the filter holder. The pipe mouthpiece is then inserted into the filter holder subassembly and over the filter holder.

The present invention also includes a pipe bowl assembly which is installed in the golf club shaft at a location below the rubber grip. In a preferred embodiment, a hole is drilled through one side of the golf club assembly, preferably at least twelve inches from the top end of the golf club grip. The pipe bowl assembly includes a bowl fitting and a pipe bowl and this assembly is inserted into the hole which is drilled through the side of the golf club shaft.

In a preferred embodiment, a putter is attached to the golf club shaft, although any golf club head may be used.

Other objects and features of the invention, both as to construction and its method of operation, together with additional objects and advantages thereof, will become apparent and best understood from review of the following description of the preferred embodiment when run in conjunction with the accompanying drawings.

DETAILED DESCRIPTION OF THE PREFERRED EMBODIMENT

Figure 1:
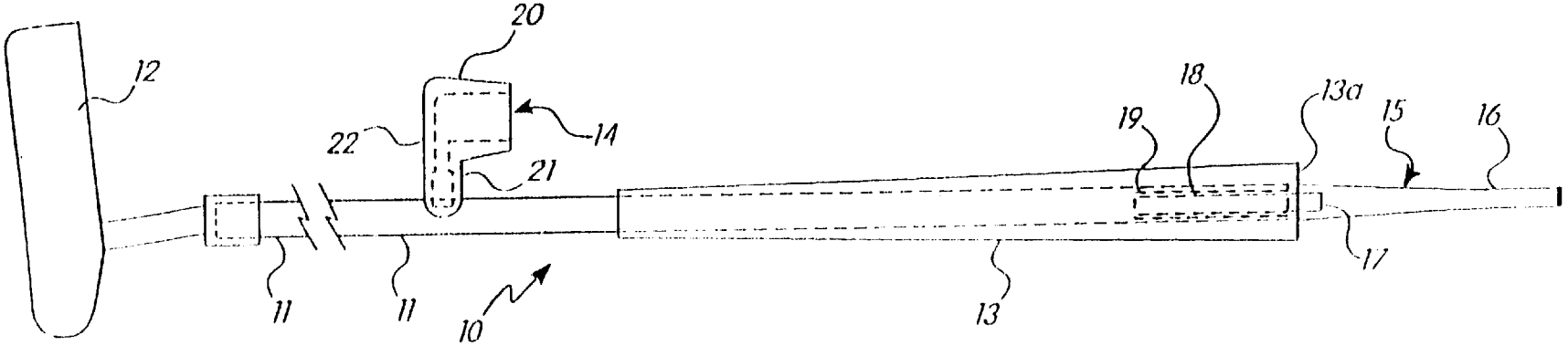
FIG. 1 is a side cut away view of the golf club and smoking pipe assembly according to the present invention.
Figure 5A:
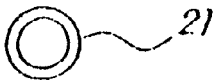
FIG. 5A is a side cut away view of the bowl fitting of the present invention.
Figure 5B:
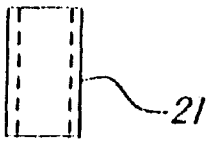
FIG. 5B is a top view of the bowl fitting of the present invention.
Figure 4:
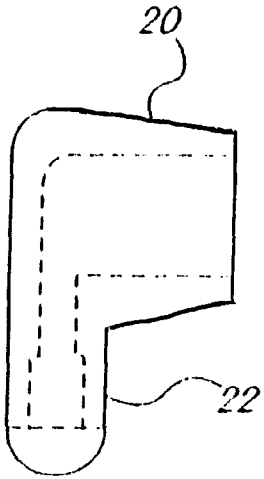
FIG. 4 is a side cut away view of the pipe bowl of the present invention.

FIG. 1 is a side view of the golf club with attached pipe smoking assembly of the present invention. The smoking assembly 10 includes a hollow golf club shaft 11, a golf club head 12, a rubber grip 13, a smoking bowl subassembly 14 and a mouthpiece assembly 15. In a preferred embodiment of the present invention, hollow shaft 11, golf club head 12 and rubber grip 13 are standard items. Golf club head 12, in a preferred embodiment, is a putter. However, any golf club head may be used in connection with the present invention. Pipe bowl subassembly 14 attaches to the side of shaft 11 and through a hole which is drilled into shaft 11. Mouthpiece subassembly 15 attaches at the top of shaft 11 and through the top cap of rubber grip 13. In this latter respect, a hole is drilled in the top cap 13*a* of rubber grip 13.

Figure 3A:
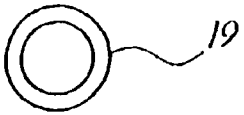
FIG. 3A is a side cut away view of the stem filter seal of the present invention.
Figure 3B:
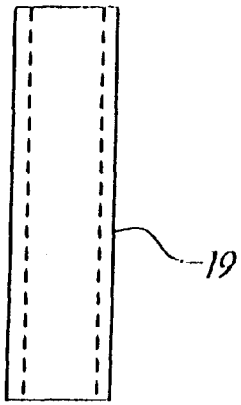
FIG. 3B is a to view of the stem filter seal of the present invention.
Figure 2:
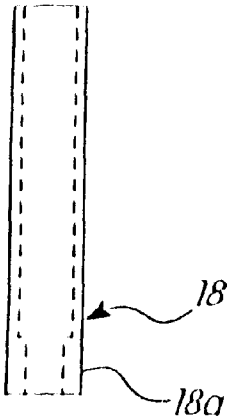
FIG. 2 is a side cut away view of the stem filter holder of the present invention.
Figure 7:
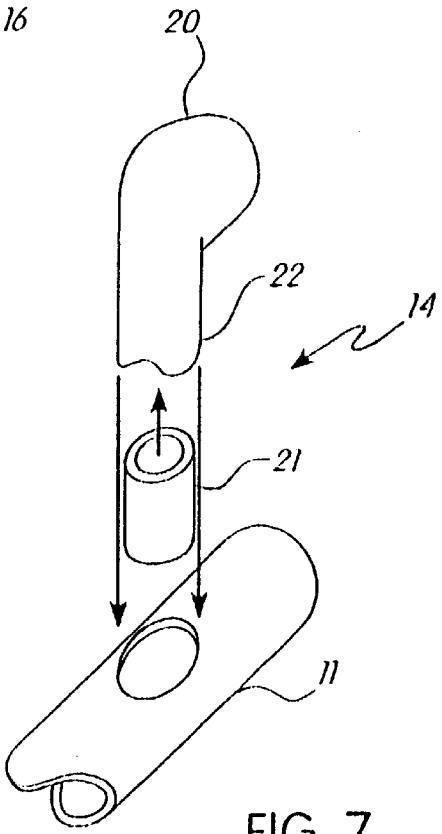
FIG. 7 is an exploding view of the pipe bowl assembly of the present invention.
Figure 6:
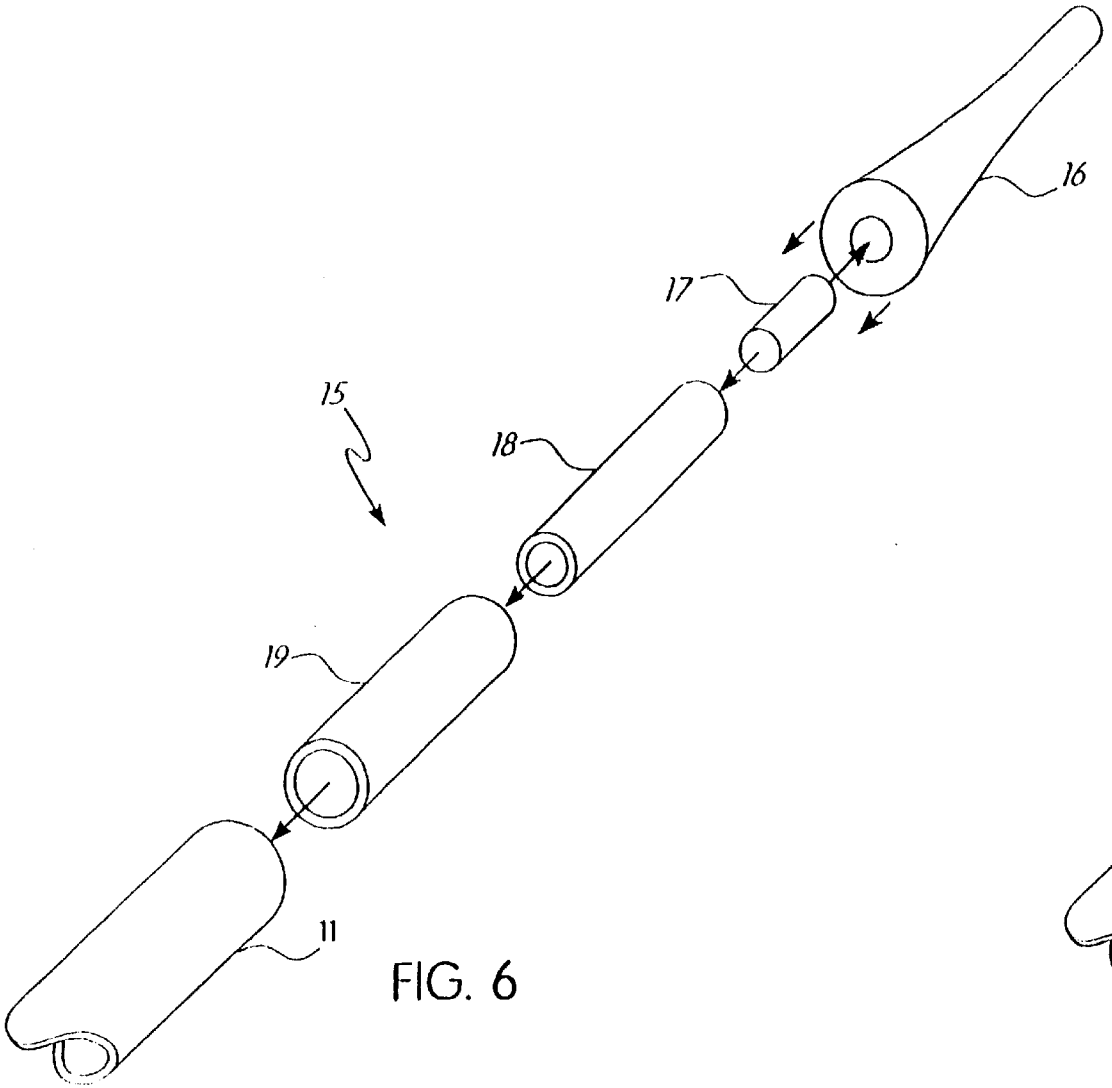
FIG. 6 is an exploding view of the mouthpiece assembly of the present invention.

Referring to FIGS. 1, 2 and 3, mouthpiece subassembly 15 includes a mouthpiece 16, a filter 17, a stem filter holder 18 and a stem filter seal 19. Mouthpiece subassembly 15 is assembled by working, first, with shaft 11 without rubber grip 13 in place over shaft 11. Stem filter holder 18 is inserted into stem filter seal 19 so that the bottoms of each are flush with one another. In a preferred embodiment of the invention, the top part of stem filter holder 18 extends above stem filter seal 19. This subassembly of stem filter seal 19 and stem filter holder 18 is then inserted into the top hollow end of hollow shaft 11 so that the top of stem filter seal 19 is flush with the top of hollow shaft 11. Next, rubber grip 13 is slid into place over shaft 11, preferably through use of a lubricant such as dishwashing liquid. Other lubricants may also be used. Prior to attachment to shaft 11, however, rubber grip 13 is altered from its standard design by drilling and/or enlarging the vent hole in upper end 13*a* of rubber grip 13 to provide a hole approximately $\frac{3}{8}^{ths}$ inch in diameter. Once slid into place, rubber grip 13 is preferably attached using two-sided tape so that upper end 13*a* of rubber grip 13 rests directly on the top of hollow shaft 11. Filter 17 is then inserted into stem filter holder 18 so that the bottom of filter 17 rests against the smaller diameter end 18*a* of stem filter holder 18. Pipe mouthpiece 16 is then inserted onto filter holder 18 and over filter 17.

In a preferred embodiment, pipe mouthpiece 16, pipe filter 17 and stem filter seal 19 are standard items which can be purchased from existing manufacturers. Stem filter seal 19 is preferably a nontoxic clear vinyl tube approximately $1\frac{7}{8}^{ths}$ inches in length.

Referring to FIG. 2, stem filter holder 18 is a specially manufactured element of the present invention which is preferably comprised of brass or aluminum and is approximately 2 inches in length. Lower end 18*a* of stem filter holder 18, as set forth above, has a smaller inside diameter than the majority of the length of stem filter holder 18. End 18*a* serves to hold pipe filter 17 from descending further into hollow shaft 11.

Referring to FIGS. 1, 4, 5, 6 and 7, pipe bowl subassembly 14 includes pipe bowl 20 and bowl fitting 21. Pipe bowl 20 is also a standard item. Bowl fitting 21 is specially manufactured for the present invention and is preferably a brass or aluminum hollow tube approximately ½ inch in length.

Pipe bowl 20 is first readied for assembly into the present invention by drilling a ½ inch hole vertically through the stem of the bowl so that pipe bowl 20 has a concave end 20*a* which will wrap around and contact the exterior diameter of shaft 11 in a flush manner. In order to facilitate this connection, bowl fitting 21 is inserted into the stem 22 of pipe bowl 20. Bowl fitting 21 has a sufficient length so that the bottom end of bowl fitting 21 extends beyond the end of stem 22. The extending end of bowl fitting 21 is then inserted into a hole which has been drilled into the side of shaft 11. In a preferred embodiment, this hole is drilled into one side of shaft 11 at least 12 inches from the top of the upper end of shaft 11. The hole also may be placed at greater or lesser distances from the upper end of shaft 11. Also, in a preferred embodiment, pipe bowl subassembly 14 is attached to shaft 11 such that the receiving end of pipe bowl 20 points upward toward the upper end of shaft 11 and toward mouthpiece assembly 15.

In operation, hollow shaft 11 serves as a conduit for pipe tobacco smoke which is generated from pipe bowl subassembly 14 and which travels up shaft 11 towards mouthpiece subassembly 15.

In an alternative embodiment of the present invention, a hollow tube 23 can be inserted into shaft 11 so that it runs from mouthpiece subassembly 15 to pipe bowl subassembly 14 in such a manner that the pipe tobacco smoke generated from pipe bowl subassembly 14 contacts only the internal diameter of this hollow tube 23 and not the inside diameter of shaft 11. Additionally, a stop element 24 can be inserted into shaft 11 to prevent any pipe tobacco smoke from passing downward along the lower end of shaft 11.

What is claimed is:

1. A novelty golf club with attached smoking pipe assembly, including:

a. a golf club with a golf club head, a hollow shaft with a hole drilled into the side of said shaft and a rubber grip at the upper end of said shaft;

b. a pipe bowl subassembly attached to said hollow shaft at the hole drilled into said hollow shaft; and c. a mouthpiece subassembly which is attached to the upper end of said hollow shaft and said rubber grip.

2. The golf club/smoking pipe assembly of claim 1, wherein said golf club head is a putter.

3. The golf club/smoking pipe assembly of claim 1, wherein said pipe bowl subassembly includes a standard pipe bowl and a bowl fitting which inserts into the hole drilled into said hollow shaft and into the stem of said pipe bowl so as to join said pipe bowl to said hollow shaft.

4. The golf club/smoking pipe assembly of claim 1, wherein said mouthpiece assembly includes:

a. a stem filter seal;

b. a filter holder which inserts into said stem filter seal;

c. a standard pipe filter which inserts into said filter holder; and d. a standard pipe mouthpiece which inserts onto said filter holder and over said pipe filter.

5. The golf club/smoking pipe assembly of claim 1, wherein said assembly further comprises a hollow tube inserted into said hollow shaft, said tube joining with said mouthpiece subassembly and said pipe bowl subassembly so that pipe tobacco smoke generated by said pipe bowl subassembly travels to said mouthpiece subassembly without contacting the inside diameter of said hollow shaft.

6. The golf club/smoking pipe assembly of claim 1, wherein said assembly further comprises a stop element which prevents pipe tobacco smoke generated by said pipe bowl subassembly from traveling downward within said hollow shaft.

* * * * *